US011334006B1

(12) United States Patent
Tanemura et al.

(10) Patent No.: US 11,334,006 B1
(45) Date of Patent: May 17, 2022

(54) TRANSFER DEVICE, IMAGE FORMING APPARATUS, AND ENDLESS BELT

(71) Applicant: FUJIFILM Business Innovation Corp., Tokyo (JP)

(72) Inventors: Daisuke Tanemura, Kanagawa (JP); Shigeru Fukuda, Kanagawa (JP); Satoya Sugiura, Kanagawa (JP); Tomotake Inagaki, Kanagawa (JP); Masato Ono, Kanagawa (JP); Masato Furukawa, Kanagawa (JP); Hiroaki Tanaka, Kanagawa (JP); Kenta Yamakoshi, Kanagawa (JP); Ryohei Yoshikawa, Kanagawa (JP); Yosuke Kubo, Kanagawa (JP); Masayuki Seko, Kanagawa (JP); Koichi Matsumoto, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/308,362

(22) Filed: May 5, 2021

(30) Foreign Application Priority Data

Nov. 6, 2020 (JP) ..... JP2020-186031

(51) Int. Cl.
*G03G 15/16* (2006.01)

(52) U.S. Cl.
CPC ..... *G03G 15/162* (2013.01); *G03G 15/161* (2013.01); *G03G 15/1605* (2013.01); *G03G 15/1685* (2013.01); *G03G 2215/1623* (2013.01)

(58) Field of Classification Search
CPC ..... G03G 15/1605; G03G 15/161; G03G 15/162; G03G 15/1685; G03G 2215/1623
See application file for complete search history.

(56) References Cited

U.S. PATENT DOCUMENTS

2005/0170274 A1* 8/2005 Matsumura ..... G03G 15/0131 430/125.32
2007/0025740 A1* 2/2007 Katoh ..... C08L 2666/20 399/1
2012/0082488 A1* 4/2012 Kubo ..... G03G 15/162 399/302

FOREIGN PATENT DOCUMENTS

JP 2007-011117 A 1/2007
JP 2007-078789 A 3/2007

* cited by examiner

*Primary Examiner* — Joseph S Wong
(74) *Attorney, Agent, or Firm* — Sughrue Mion, PLLC

(57) ABSTRACT

An endless belt includes: a resin; and electrically conductive particles, wherein an integrated discharge amount is 350 μC or less. The integrated discharge amount is determined by disposing an electrode at a position spaced 60 μm apart from the outer circumferential surface of the belt, applying a voltage to the electrode, and measuring the amount of discharge for a period of 1 second after the voltage reaches 1300 V.

20 Claims, 2 Drawing Sheets

TRANSFER DEVICE, IMAGE FORMING APPARATUS, AND ENDLESS BELT

CROSS-REFERENCE TO RELATED APPLICATIONS

This application is based on and claims priority under 35 USC 119 from Japanese Patent Application No. 2020-186031 filed Nov. 6, 2020.

BACKGROUND

(i) Technical Field

The present disclosure relates to a transfer device, to an image forming apparatus, and to an endless belt.

(ii) Related Art

In electrophotographic image forming apparatuses (such as copiers, facsimiles, and printers), a toner image formed on a surface of an image holding member is transferred onto a surface of a recording medium and fixed on the recording medium to form an image. To transfer a tone image onto a recording medium, an electrically conductive endless belt such as an intermediate transfer belt is used.

For example, Japanese Unexamined Patent Application Publication No. 2007-011117 discloses "an intermediate transfer belt including at least a surface layer on a substrate, wherein the surface layer contains aggregates of electrically conductive particles having an average particle diameter of 0.5 to 25 μm."

Japanese Unexamined Patent Application Publication No. 2007-078789 discloses "an intermediate transfer belt including at least a surface layer on a substrate, wherein the surface layer contains metal-coated fine resin particles."

SUMMARY

In an image forming apparatus that uses an endless belt as an intermediate transfer body, when a recording medium having large surface irregularities such as embossed paper (hereinafter referred to also as a "non-smooth paper sheet") is used, the intermediate transfer body cannot follow the irregularities of the recording medium when a toner image is transferred from the intermediate transfer body onto the recording medium. In this case, transferability deteriorates, so that white patches may be formed in the image.

Aspects of non-limiting embodiments of the present disclosure relate to an endless belt that contains a resin and electrically conductive particles and that, when the endless belt is used as an intermediate transfer body, exhibits better transferability onto a non-smooth paper sheet than an endless belt in which an integrated discharge amount described later is more than 350 μC.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an endless belt containing a resin and electrically conductive particles, wherein an integrated discharge amount is 350 μC or less, the integrated discharge amount being determined by disposing an electrode at a position spaced 60 μm apart from the outer circumferential surface of the belt, applying a voltage to the electrode, and measuring the amount of discharge for a period of 1 second after the voltage reaches 1300 V.

BRIEF DESCRIPTION OF THE DRAWINGS

Exemplary embodiments of the present disclosure will be described in detail based on the following figures, wherein.

DETAILED DESCRIPTION

Figure 1:
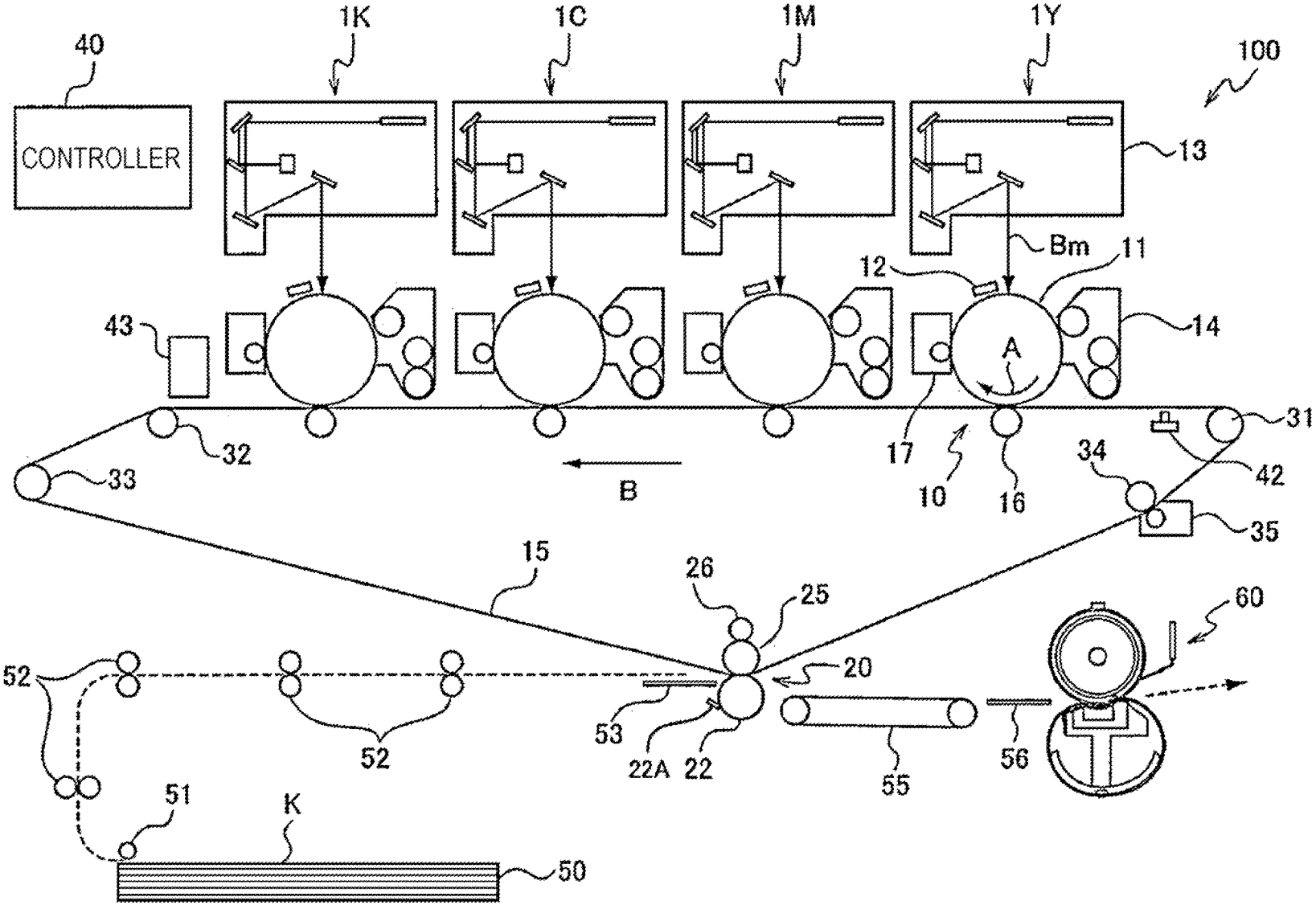
FIG. 1 is a schematic illustration showing an example of an image forming apparatus according to an exemplary embodiment.

Exemplary embodiments of the disclosure will be described below. The following description and Examples are illustrative of the exemplary embodiments and are not intended to limit the scope of the exemplary embodiments.

In a set of numerical ranges expressed in a stepwise manner in an exemplary embodiment, the upper or lower limit in one numerical range may be replaced with the upper or lower limit in another numerical range in the set. Moreover, in a numerical range described in an exemplary embodiment, the upper or lower limit in the numerical range may be replaced with a value indicated in an Example.

In the exemplary embodiments, the term "step" is meant to include not only an independent step but also a step that is not clearly distinguished from other steps, so long as the prescribed purpose of the step can be achieved.

In each exemplary embodiment, when the exemplary embodiment is explained with reference to the drawings, the structure of the exemplary embodiment is not limited to the structure shown in the drawings. In the drawings, the sizes of the components are conceptual, and the relative relations between the components are not limited to the illustrated relations.

In each exemplary embodiment, any component may contain a plurality of materials corresponding to the component. In each exemplary embodiment, when reference is made to the amount of a component in a composition, if the composition contains a plurality of materials corresponding to the component, the amount means the total amount of the plurality of materials, unless otherwise specified.

[Endless Belt]

An endless belt according to an exemplary embodiment contains a resin and an electrically conductive particles, wherein an integrated discharge amount is 350 μC or less. The integrated discharge amount is determined by disposing an electrode at a position spaced 60 μm apart from the outer circumferential surface of the belt, applying a voltage to the electrode, and measuring the amount of discharge for a period of 1 second after the voltage reaches 1300 V.

Hereinafter, "the characteristic that the integrated discharge amount determined by disposing an electrode at a position spaced 60 μm apart from the outer circumferential surface of the belt, applying a voltage to the electrode, and measuring the amount of discharge for a period of 1 second after the voltage reaches 1300 V is 350 μC or less" is referred to also as a "discharge characteristic."

The endless belt according to the present exemplary embodiment satisfies the above discharge characteristic and therefore exhibits good transferability onto a non-smooth paper sheet when used as an intermediate transfer body. The reason for this is not clear but may be as follows.

In an image forming apparatus that uses an endless belt as intermediate transfer body, when a non-smooth paper sheet is used as a recording medium, the intermediate transfer body may not follow the irregularities of the recording medium when a toner image is transferred from the intermediate transfer body onto the recording medium. In this case, transferability deteriorates, so that white patches may be formed in the image. Specifically, for example, a sufficient transfer electric field tends not to be easily formed in recessed portions of the recording medium. Therefore, when the electric field during transfer is increased, an excessively large local electric field is applied to protruding portions of the recording medium, and this causes abnormal discharge. In this case, a reduction in transferability may occur due to a reduction in the charge amount of the toner or reverse charging.

In tandem-type image forming apparatuses, a plurality of mono-color images are overprinted on an intermediate transfer body to obtain a multi-color image, and the multi-color image is transferred from the intermediate transfer body onto a recording medium. In particular, in an tandem-type image forming apparatus that uses toners with a small particle diameter, a significant reduction in transferability tends to occur.

However, in the endless belt according to the present exemplary embodiment, it is inferred that, even when an excessively large electric field is applied locally to protruding portions of a non-smooth paper sheet, the amount of discharge can be reduced. In this case, a reduction in the charge amount of the toner or reverse charging due to abnormal discharge can be prevented, and the transferability is improved.

In particular, by reducing the amount of discharge when a voltage is applied to the electrode disposed at a position spaced 60 μm apart from the outer circumferential surface of the belt, reverse charging of the toner can be prevented. This is because of the following reason. The discharge characteristic described above indicates a reduction in the amount of discharge in a blue discharge region, and the reverse charging of toner occurs in the blue discharge region (430 nm). For example, the discharge wavelength of discharge when a voltage is applied to an electrode disposed at a position 200 μm apart from the outer circumferential surface of a belt is in a reddish purple range (750 nm). In this case, the amount of discharge in an endless belt A1 in an Example described later dose not differ from that in an endless belt D1 (in a Comparative Example).

In the present specification, the term "electrically conductive" means that the volume resistivity at 20° C. is lower than $1\times10^{13}$ Ω cm.

It is therefore inferred that, when the endless belt according to the present exemplary embodiment is used as an intermediate transfer body, excellent transferability onto a non-smooth paper sheet is obtained.

The endless belt according to the present exemplary embodiment will be described in detail.

<Discharge Characteristic>

In the endless belt according to the present exemplary embodiment, the integrated discharge amount (hereinafter referred to also as a "discharge amount") is 350 μC or less, the integrated discharge amount being determined by disposing an electrode at a position spaced 60 μm apart from the outer circumferential surface of the belt, applying a voltage to the electrode, and measuring the amount of discharge for a period of 1 second after the voltage reaches 1300 V. From the viewpoint of the transferability onto a non-smooth paper sheet, the discharge amount is preferably 200 μC or less and more preferably 150 μC or less. The smaller the discharge amount, the better from the viewpoint of improving the transferability onto a non-smooth paper sheet. However, the lower limit of the discharge amount is, for example, 10 μC or more.

Specifically, the discharge amount is preferably from 10 μC to 200 μC inclusive and more preferably from 10 μC to 150 μC inclusive.

In the measurement of the discharge amount, since the discharge rises slowly after the application of the voltage, the discharge amount is defined as the amount of current generated in a period of 1 second after the voltage reaches 1300 V.

No particular limitation is imposed on the method for adjusting the discharge amount to the above-described range. Examples of the method include: a method in which particles with a small number average primary particle diameter are used as the electrically conductive particles; a method in which the type of electrically conductive particles used is appropriately selected; and a method in which conditions in an endless belt production process (such as drying conditions) are controlled.

The method for measuring the discharge amount is as follows.

With a film having a thickness of 60 μm disposed on the outer circumferential surface of the endless belt, two electrode plates are used to sandwich the endless belt and the film and then fixed. Next, the film is removed, so that a gap of 60 μm is provided between the outer circumferential surface of the endless belt and the electrode plate disposed on the outer circumferential surface of the endless belt.

Next, a power source is connected to the two electrode plates, and a voltage is applied to the electrode plates. Then the amount of the current generated in a period of 1 second after the voltage reaches 1300 V is measured. The amount of the current generated in the period of 1 second is used as the integrated discharge amount.

<Layer Structure>

The endless belt according to the present exemplary embodiment contains a resin (hereinafter may be referred to as a "first resin") and electrically conductive particles (hereinafter may be referred to as "first electrically conductive particles").

The endless belt may be a single-layer belt or a layered belt. Specifically, the endless belt is a single-layer belt composed of a layer containing the first resin and the first electrically conductive particles or a layered belt including the above layer as a surface layer forming the outer circumferential surface of the endless belt.

When the endless belt is a single-layer belt, the single-layer belt forms a layer containing the first resin and the first electrically conductive particles.

When the endless belt is a layered belt, the layered belt includes, for example, a base layer and a surface layer disposed on the base layer. The surface layer is the outermost layer of the endless belt. The layered belt may include an additional layer between the base layer and the surface layer.

When the endless belt is a layered belt including a base layer and a surface layer, the surface layer is a layer containing the first resin and the first electrically conductive particles. No particular limitation is imposed on the base layer, and examples thereof include a layer containing a second resin and second electrically conductive particles.

The layer in a single-layer endless belt is referred to also as a "single layer." In a layered endless belt, the surface layer containing the first resin and the first electrically conductive particles is referred to also as a "first layer," and the base layer containing the second resin and the second electrically conductive particles is referred to also as a "second layer."

<Resins>

Examples of the first resin contained in the single layer or the first layer include polyimide resins (PI resins), polyamide-imide resins (PAI resins), aromatic polyether ketone resins (such as aromatic polyether ether ketone resins), polyphenylene sulfide resins (PPS resins), polyetherimide resins (PEI resins), polyester resins, polyamide resins, and polycarbonate resins. Preferably, the first resin includes at least one selected from the group consisting of polyimide resins, polyamide-imide resins, aromatic polyether ether ketone resins, polyetherimide resins, and polyphenylene sulfide resins, from the viewpoint of mechanical strength and the dispersibility of the first electrically conductive particles. More preferably, the first resin includes at least one selected from the group consisting of polyimide resins and polyamide-imide resins. In particular, from the viewpoint of mechanical strength, polyimide resins are still more preferable.

The first resin may be composed of one resin or may be a mixture of two or more resins.

The first resin may include an electrically conductive resin. Specifically, the first resin may be a mixture of a non-electrically conductive resin and an electrically conductive resin. The electrically conductive resin is, for example, at least one selected from the group consisting of polyaniline resins and polyether resins.

Specific examples and preferred examples of the second resin contained in the second layer are the same as the specific examples and the preferred examples of the first resin. The second resin may be composed of one resin or may be a mixture of two or more resins.

When the endless belt includes the first layer and the second layer, the first resin and the second resin may be the same resin or different resins and are preferably the same resin (for example, the first resin and the second resin are both a polyimide resin).

(Polyimide Resins)

Examples of the polyimide resins include imidized products of polyamic acids (precursors of polyimide resins) that are polymers of tetracarboxylic dianhydrides and diamine compounds.

Examples of the polyimide resins include resins having a structural unit represented by the following general formula (I).

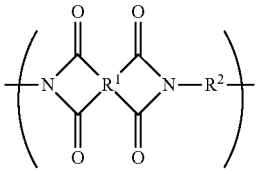

General Formula (I)

In general formula (I), $R^1$ represents a tetravalent organic group, and $R^2$ represents a divalent organic group.

Examples of the tetravalent organic group represented by $R^1$ include aromatic groups, aliphatic groups, alicyclic groups, combinations of aromatic and aliphatic groups, and substituted groups thereof. Specific examples of the tetravalent organic group include residues of tetracarboxylic dianhydrides described later.

Examples of the divalent organic group represented by $R^2$ include aromatic groups, aliphatic groups, alicyclic groups, combinations of aromatic and aliphatic groups, and substituted groups thereof. Specific examples of the divalent organic group include residues of diamine compounds described later.

Specific examples of the tetracarboxylic dianhydride used as a raw material of the polyimide resin include pyromellitic dianhydride, 3,3',4,4'-benzophenonetetracarboxylic dianhydride, 3,3',4,4'-biphenyltetracarboxylic dianhydride, 2,3,3',4-biphenyltetracarboxylic dianhydride, 2,3,6,7-naphthalenetetracarboxylic dianhydride, 1,2,5,6-naphthalenetetracarboxylic dianhydride, 1,4,5,8-naphthalenetetracarboxylic dianhydride, 2,2'-bis(3,4-dicarboxyphenyl)sulfonic dianhydride, perylene-3,4,9,10-tetracarboxylic dianhydride, bis(3,4-dicarboxyphenyl)ether dianhydride, and ethylenetetracarboxylic dianhydride.

Specific examples of the diamine compound used as a raw material of the polyimide resin include 4,4'-diaminodiphenyl ether, 4,4'-diaminodiphenylmethane, 3,3'-diaminodiphenylmethane, 3,3'-dichlorobenzidine, 4,4'-diaminodiphenyl sulfide, 3,3'-diaminodiphenylsulfone, 1,5-diaminonaphthalene, m-phenylenediamine, p-phenylenediamine, 3,3'-dimethyl-4,4'-biphenyldiamine, benzidine, 3,3'-dimethylbenzidine, 3,3'-dimethoxybenzidine, 4,4'-diaminodiphenylsulfone, 4,4'-diaminodiphenylpropane, 2,4-bis(β-amino-tert-butyl)toluene, bis(p-β-amino-tert-butylphenyl)ether, bis(p-β-methyl-δ-aminophenyl)benzene, bis-p-(1,1-dimethyl-5-amino-pentyl)benzene, 1-isopropyl-2,4-m-phenylenediamine, m-xylylenediamine, p-xylylenediamine, di(p-aminocyclohexyl)methane, hexamethylenediamine, heptamethylenediamine, octamethylenediamine, nonamethylenediamine, decamethylenediamine, diaminopropyltetramethylene, 3-methylheptamethylenediamine, 4,4-dimethylheptamethylenediamine, 2,11-diaminododecane, 1,2-bis-3-aminopropoxyethane, 2,2-dimethylpropylenediamine, 3-methoxyhexamethylenediamine, 2,5-dimethylheptamethylenediamine, 3-methylheptamethylenediamine, 5-methylnonamethylenediamine, 2,17-diaminoeicosadecane, 1,4-diaminocyclohexane, 1,10-diamino-1,10-dimethyldecane, 12-diaminooctadecane, 2,2-bis[4-(4-aminophenoxy)phenyl]propane, piperazine, $H_2N(CH_2)_3O(CH_2)_2O(CH_2)NH_2$, $H_2N(CH_2)_3S(CH_2)_3NH_2$, and $H_2N(CH_2)_3N(CH_3)_2(CH_2)_3NH_2$.

(Polyamide-Imide Resin)

Examples of the polyamide-imide resin include resins having a repeating unit including an imide bond and an amide bond.

More specific examples of the polyamide-imide resin include a polymer of a trivalent carboxylic acid compound (referred to also as a tricarboxylic acid) having an acid anhydride group with a diisocyanate compound or a diamine compound.

The tricarboxylic acid may be trimellitic anhydride or a derivative thereof. The tricarboxylic acid may be used in combination with a tetracarboxylic dianhydride, an aliphatic dicarboxylic acid, an aromatic dicarboxylic acid, etc.

Examples of the diisocyanate compound include 3,3'-dimethylbiphenyl-4,4'-diisocyanate, 2,2'-dimethylbiphenyl-4,4'-diisocyanate, biphenyl-4,4'-diisocyanate, biphenyl-3,3'-diisocyanate, biphenyl-3,4'-diisocyanate, 3,3'-diethylbiphenyl-4,4'-diisocyanate, 2,2'-diethylbiphenyl-4,4'-diisocyanate, 3,3'-dimethoxybiphenyl-4,4'-diisocyanate, 2,2'-dimethoxybiphenyl-4,4'-diisocyanate, naphthalene-1,5-diisocyanate, and naphthalene-2,6-diisocyanate.

Examples of the diamine compound include compounds that have structures similar to the structures of the above isocyanates and have amino groups instead of the isocyanato groups.

(Aromatic Polyether Ketone Resin)

Examples of the aromatic polyether ketone resin include a resin in which aromatic rings such as benzene rings are linearly bonded through ether and ketone bonds.

Examples of the aromatic polyether ketone resin include polyether ketones (PEK) in which ether bonds and ketone bonds are alternately arranged, polyether ether ketones (PEEK) including a repeating unit including an ether bond, another ether bond, and a ketone bond arranged in this order, polyether ketone ketones (PEKK) including a repeating unit including an ether bond, a ketone bond, and another ketone bond arranged in this order, polyether ether ketone (PEEKK) including a repeating unit including an ether bond, another ether bond, a ketone bond, and another ketone bond arranged in this order, and polyether ketone esters including an ester bond.

From the viewpoint of controlling strength, volume resistivity, etc., the content of the first resin with respect to the total mass of the single layer is preferably from 60% by mass to 95% by mass inclusive, more preferably from 70% by mass to 95% by mass inclusive, and still more preferably from 75% by mass to 90% by mass inclusive.

From the viewpoint of controlling strength, volume resistivity, etc., the content of the first resin with respect to the total mass of the first layer is preferably from 60% by mass to 95% by mass inclusive, more preferably from 70% by mass to 95% by mass inclusive, and still more preferably from 75% by mass to 90% by mass inclusive.

From the viewpoint of controlling strength, volume resistivity, etc., the content of the second resin with respect to the total mass of the second layer is preferably from 60% by mass to 95% by mass inclusive, more preferably from 70% by mass to 95% by mass inclusive, and still more preferably from 75% by mass to 90% by mass inclusive.

<Electrically Conductive Particles>

The first electrically conductive particles contained in the single layer or the first layer are, for example, at least one type of particles selected from the group consisting of electrically conductive carbon particles and metal oxide particles.

Examples of the electrically conductive carbon particles include carbon black.

Examples of the carbon black include Ketjen black, oil furnace black, channel black, and acetylene black. The carbon black used may be carbon black with a treated surface (referred to also as "surface-treated carbon black").

The surface-treated carbon black is obtained by adding, for example, carboxy groups, quinone groups, lactone groups, or hydroxy groups to its surface. Examples of the surface treatment method include an air oxidation method in which carbon black is brought into contact with air in a high-temperature atmosphere to react therewith, a method in which carbon black is allowed to react with nitrogen oxide or ozone at room temperature (e.g., 22° C.), and a method in which carbon black is oxidized with air in a high-temperature atmosphere and oxidized with ozone at low temperature.

Examples of the metal oxide particles include tin oxide particles, titanium oxide particles, zinc oxide particles, and zirconium oxide particles.

Other examples of the first electrically conductive particles include metal particles (such as aluminum particles and nickel particles) and ion conductive particles (such as potassium titanate particles and LiCl particles).

The number average primary particle diameter of the first electrically conductive particles is, for example, in the range of 20 nm or less. From the viewpoint of adjusting the discharge amount to the above-described range, the number average primary particle diameter is preferably in the range of 18 nm or less, more preferably in the range of 15 nm or less, and still more preferably in the range of 13 nm or less. The number average primary particle diameter of the first electrically conductive particles is for example, in the range of 2 nm or more. From the viewpoint of adjusting the discharge amount to the above-described range, the number average primary particle diameter is preferably in the range of 5 nm or more and more preferably in the range of 8 nm or more.

The number average primary particle diameter of the second electrically conductive particles is, for example, in the range of from 2 nm to 40 nm inclusive. From the viewpoint of dispersibility, mechanical strength, volume resistivity, film formability, etc., the number average primary particle diameter is preferably in the range of from 10 nm to 40 nm inclusive, more preferably in the range of from 10 nm to 35 nm inclusive, and still more preferably in the range of from 10 nm to 28 nm inclusive.

When the endless belt includes the first layer and the second layer, the number average primary particle diameter of the first electrically conductive particles may be smaller than the number average primary particle diameter of the second electrically conductive particles. The number average primary particle diameter of the first electrically conductive particles may be equal to or more than 0.5 times and less than 1.1 times the number average primary particle diameter of the second electrically conductive particles.

The number average primary particle diameter of the electrically conductive particles is measured by the following method.

First, a measurement sample with a thickness of 100 nm is taken from each layer of the obtained belt using a microtome. The measurement sample is observed under a TEM (transmission electron microscope). The diameters of circles having areas equal to the projected areas of 50 electrically conductive particles (i.e., their equivalent circle diameters) are used as their particle diameters, and their average value is used as the number average primary particle diameter.

When the first resin includes at least one selected from the group consisting of polyimide resins and polyamide-imide resins and the single layer or the first layer is formed using a first coating solution described later, the first electrically conductive particles are preferably channel black particles and more preferably surface-treated channel black particles, from the viewpoint of adjusting the discharge amount to the above-described range.

When the first coating solution is used to form the single layer or the first layer, the pH of the first electrically conductive particles is, for example, in the range of from 1.0 to 5.5 inclusive and is preferably in the range of from 1.0 to 3.0 inclusive, from the viewpoint of adjusting the discharge amount to the above-described range.

When the second layer is formed using a second coating solution described later, the pH of the second electrically conductive particles is, for example, in the range of from 1.0 to 5.5 inclusive and preferably in the range of from 1.0 to 3.0 inclusive, from the viewpoint of adjusting the discharge amount to the above-described range.

When the endless belt includes the first layer formed using the first coating solution and the second layer formed using the second coating solution, the pH of the first electrically conductive particles may be smaller than the pH of the second electrically conductive particles.

When the first resin contains at least one selected from the group consisting of polyetherimide resins, aromatic polyether ether ketone resins, and polyphenylene sulfide resins and the single layer or the first layer is formed using melt extrusion described later, the first electrically conductive particles are preferably channel black or furnace black particles and more preferably channel black or furnace black particles whose surface is untreated, from the viewpoint of adjusting the discharge amount to the above-described range.

The first electrically conductive particles may be composed of one type of electrically conductive particles or may be a mixture of two or more types of electrically conductive particles.

Specific examples of the second electrically conductive particles contained in the second layer are the same as the specific examples of the first electrically conductive particles.

The content of the first electrically conductive particles with respect to the total mass of the single layer is preferably from 10% by mass to 50% by mass inclusive, more preferably from 13% by mass to 40% by mass inclusive, and still more preferably from 15% by mass to 30% by mass inclusive, from the viewpoint of reducing the discharge amount and from the viewpoint of obtaining sufficient strength.

The content of the first electrically conductive particles with respect to the total mass of the first layer is preferably from 10% by mass to 50% by mass inclusive, more preferably from 13% by mass to 40% by mass inclusive, and still more preferably from 15% by mass to 30% by mass inclusive, from the viewpoint of reducing the discharge amount and from the viewpoint of obtaining sufficient strength.

The content of the second electrically conductive particles with respect to the total mass of the second layer is preferably from 5% by mass to 40% by mass inclusive, more preferably from 10% by mass to 30% by mass inclusive, and still more preferably from 20% by mass to 30% by mass inclusive, from the viewpoint of controlling dispersibility, mechanical strength, and volume resistivity.

<Additional Components>

Each of the single layer, the first layer, and the second layer may contain additional components other than the resin and the electrically conductive particles.

Examples of the additional components include a conducting agent other than the electrically conductive particles, a filler for increasing the strength of the belt, an antioxidant for preventing thermal degradation of the belt, a surfactant for improving flowability, and a heat resistant antioxidant.

When one of the above layers contains any of the additional components, the content thereof with respect to the total mass of the layer is preferably more than 0% by mass and 10% by mass or less, more preferably more than 0% by mass and 5% by mass or less, and still more preferably more than 0% by mass and 1% by mass or less.

<Properties of Endless Belt>

(Thickness of Endless Belt)

The thickness of the single layer is preferably from 60 μm and 120 μm inclusive and more preferably 80 μm and 120 μm inclusive, from the viewpoint of the mechanical strength of the belt.

The thickness of the first layer is preferably from 1 μm to 60 μm inclusive and more preferably from 3 μm to 60 μm inclusive, from the viewpoint of production suitability and from the viewpoint of preventing discharge.

The thickness of the second layer is preferably from 10 μm to 80 μm inclusive and more preferably from 20 μm to 40 μm inclusive, from the viewpoint of the mechanical strength of the belt.

When the endless belt includes the first layer and the second layer, the ratio of the thickness of the first layer to the total thickness of the belt is preferably from 3% to 90% inclusive and more preferably from 5% to 80% inclusive, from the viewpoint of the transferability onto a non-smooth paper sheet.

The thickness of each layer is measured as follows.

Specifically, a cross section of the endless belt in its thickness direction is observed under an optical microscope or a scanning electron microscope. The thickness of the layer of interest is measured at 10 points, and the average value is used as the thickness.

(Volume Resistivity of Endless Belt)

The common logarithm of the volume resistivity of the endless belt when a voltage of 500 V is applied to the endless belt for 10 seconds is preferably from 9.0 (log Ω·cm) to 13.5 (log Ω·cm) inclusive, more preferably from 9.5 (log Ω·cm) to 13.2 (log Ω·cm) inclusive, and particularly preferably from 10.0 (log Ω·cm) to 12.5 (log Ω·cm) inclusive, from the viewpoint of the transferability onto a non-smooth paper sheet.

The volume resistivity of the endless belt when a voltage of 500 V is applied to the endless belt for 10 seconds is measured by the following method.

A microcurrent meter (R8430A manufactured by Advantest) is used as a resistance measurement device, and the probe used is a UR probe (manufactured by Mitsubishi Chemical Analytech Co., Ltd.). The volume resistivity (log Ω·cm) of the endless belt is measured using a voltage of 500 V, an application time of 10 seconds, and a load of 1 kgf at a total of 18 points, i.e., 6 points spaced circumferentially at regular intervals in each of 3 portions including a widthwise central portion and opposite widthwise edge portions, and then the average value is computed. The measurement is performed in an environment at a temperature of 22° C. and a humidity of 55% RH.

(Surface Resistivity of Endless Belt)

The common logarithm of the surface resistivity of the endless belt when a voltage of 500 V is applied to the outer circumferential surface of the endless belt for 10 seconds is preferably from 10.0 (log Ω/sq.) to 15.0 (log Ω/sq.) inclusive, more preferably from 10.5 (log Ω/sq.) to 14.0 (log Ω/sq.) inclusive, and particularly preferably from 11.0 (log Ω/sq.) to 13.5 (log Ω/sq.) inclusive, from the viewpoint of the transferability onto a non-smooth paper sheet.

The unit "log Ω/sq." of the surface resistivity is the logarithm of the resistance value per unit area and is denoted also by log Ω/square, log Ω/□, etc.

The surface resistivity of the endless belt when a voltage of 500 V is applied to the outer circumferential surface of the endless belt for 10 seconds is measured by the following method.

A microcurrent meter (R8430A manufactured by Advantest) is used as a resistance measurement device, and the probe used is a UR probe (manufactured by Mitsubishi Chemical Analytech Co., Ltd.). The surface resistivity (log Ω/sq.) of the outer circumferential surface of the endless belt is measured using a voltage of 500 V, an application time of 10 seconds, and a load of 1 kgf at a total of 18 points, i.e., 6 points on the outer circumferential surface spaced circumferentially at regular intervals in each of 3 portions including a widthwise central portion and opposite widthwise edge portions, and then the average value is computed. The measurement is performed in an environment at a temperature of 22° C. and a humidity of 55% RH.

(Microhardness of Endless Belt)

The microhardness of the outer circumferential surface of the endless belt is preferably from 350 nN/mm$^2$ to 650 nN/mm$^2$ inclusive and more preferably from 430 nN/mm$^2$ to 645 nN/mm$^2$ inclusive.

When the microhardness of the outer circumferential surface of the endless belt is in the above range, air layers in a non-smooth paper sheet can be easily squeezed between the endless belt and a second transfer member in a second transfer region, and the transferability onto a non-smooth paper sheet may be further improved.

In particular, when the microhardness of the outer circumferential surface of the endless belt is in the above range and the contact pressure between the second transfer member and an intermediate transfer body using the endless belt is set to 70 N or more, air layers in a non-smooth paper sheet can be easily squeezed between the endless belt and the second transfer member in the second transfer region, and the transferability onto a non-smooth paper sheet may be further improved.

The microhardness can be determined by a method in which the penetration depth of an indenter into a specimen is measured. The surface microhardness DH is defined by the following formula using a test load P (mN) and the penetration depth D (μm) of the indenter into the specimen (the depth of the indenter pressed into the specimen).

Formula: $DH=\alpha P/D^2$

Here, α is a constant depending on the shape of the indenter, and α=3.8584 (when the indenter used is a triangular pyramid indenter).

The microhardness of the endless belt is determined by the following method. The endless belt is cut into a small piece of about 5 mm square, and the small piece is fixed onto a glass plate using an instant adhesive. The surface microhardness of the surface of the sample is measured using an ultra-microhardness tester DUH-201S (manufactured by Shimadzu Corporation).

The measurement conditions are as follows.

Measurement environment: 22° C., 55% RH

Indenter used: triangular pyramid indenter

Test mode: 3 (soft material test)

Test load: 0.70 gf

Load rate: 0.0145 gf/sec

Retention time: 5 sec (Spatial Distribution of Electrically Conductive Particles)

In the spatial distribution of the electrically conductive particles present in an evaluation region of 6.3 μm×4.2 μm on the outer circumferential surface of the endless belt according to the present exemplary embodiment, the integrated value of a statistic L(r) represented by formula (1) below when the distance r between particles is from 0.05 μm to 0.30 μm inclusive may be from 0 to 0.1 inclusive.

In the spatial distribution of the electrically conductive particles present in the evaluation region of 6.3 μm×4.2 μm on the outer circumferential surface of the endless belt, the integrated value of the statistic L(r) represented by formula (1) below when the distance r between particles is from 0.05 μm to 0.30 μm inclusive is referred to also as an "integrated L(r) value."

When the integrated L(r) value is from 0 to 0.1 inclusive, the electrically conductive particles are finely distributed on the outer circumferential surface of the endless belt. When the intermediate transfer body, which is the endless belt, cannot follow irregularities of a recording medium, an excessively large electric field may be locally applied to protruding portions of the non-smooth paper sheet. Even in this case, weak discharge occurs at the conductive points finely distributed on the outer circumferential surface of the endless belt, so that the electric current is dispersed. This may prevent a reduction in the charge amount of the toner or reverse charging due to abnormal discharge, and the transferability may be improved.

From the viewpoint of the transferability onto a non-smooth paper sheet, the integrated L(r) value is preferably from 0 to 0.08 inclusive and more preferably from 0 to 0.06 inclusive.

$$L(r):=\sqrt{K(r)/\pi}-r \tag{1}$$

In formula (1) above, r is the distance between particles, and K(r) is the Ripley's K Function K(r) represented by formula (2) below.

$$K(r):=\frac{\sum_{i\neq j}^{N} 1(|X_i-X_j|\leq r)/s(|X_i-X_j|)}{\lambda^2} \tag{2}$$

In formula (2), $1(|X_i-X_j|\leq r)$ is an indicator function, and $X_i$ and $X_j$ are the coordinates of points i and j, respectively. $|X_i-X_j|$ is the Euclidean distance between the coordinates $X_i$ and $X_j$, and r is the distance between particles. $s(|X_i-X_j|)$ is an edge correction coefficient s(x) in the evaluation region that is represented by formula (3) below, and $x=|X_i-X_j|$. N is the total number of particles in the evaluation region, and λ is the number density of the particles in the evaluation region.

$$s(x):=L_xL_y-\frac{x}{\pi}(2L_x+2L_y-x) \tag{3}$$

In formula (3) above, $L_x$ and $L_y$ are the lengths (μm) of the sides of the evaluation region in the x and y axis directions, respectively, and $x=|X_i-X_j|$. $X_i$ and $X_j$ are the coordinates of points i and j, respectively, and $|X_i-X_j|$ is the Euclidean distance between the coordinates $X_i$ and $X_j$.

No particular limitation is imposed on the method for adjusting the integrated L(r) value to the above-described range. Examples thereof include a method in which particles with a small number average primary particle diameter are used as the electrically conductive particles, a method in which the type of electrically conductive particles used is appropriately selected, and a method in which conditions in a production process of the endless belt (such as drying conditions) are controlled.

The spatial distribution of the electrically conductive particles is obtained as follows. The outer circumferential surface of the endless belt is observed under a scanning electron microscope (such as type: SU8010 manufactured by Hitachi High-Technologies Corporation) at a magnification of 20000×. If necessary, the obtained 256-level gray-scale image is binarized using a threshold value of 128 using analysis software (such as freeware "ImageJ"). Then the statistic L(r) when the distance r between particles is from 0.05 μm to 0.30 μm inclusive is computed every 0.05 μm using the above formulas, and the integrated value in the range of from 0.05 μm to 0.30 μm inclusive is obtained.

<Method for Producing Endless Belt>

No particular limitation is imposed on the method for producing the endless belt according to the present exemplary embodiment.

An example of the method for producing the endless belt includes: a first coating solution preparing step of preparing the first coating solution containing the first resin or its precursor, the first electrically conductive particles, and a first solvent; a first coating film forming step of forming a first coating film by applying the first coating solution to the outer circumference surface of a substrate to be coated; and a first drying step of drying the first coating film while the temperature of the coated substrate is increased. The method for producing the endless belt may further include an additional step in addition to the first coating solution preparing step, the first coating film forming step, and the first drying step. Examples of the additional step when, for example, a precursor of the first resin is used include a first firing step of firing the first coating film dried in the first drying step.

When a single-layer endless belt is produced, the first coating solution preparing step, the first coating film forming step, and the first drying step are performed, and the single layer containing the first resin and the first electrically conductive particles is thereby formed on the outer circumferential surface of the substrate. The single layer may be formed, for example, by preparing pellets containing the first resin and the first electrically conductive particles and subjecting the pellets to melt extrusion.

When a layered endless belt is produced, the first coating solution preparing step, the first coating film forming step, and the first drying step, for example, are performed, and the first layer containing the first resin and the first electrically conductive particles is thereby formed on the outer circumferential surface of the second layer formed on a substrate.

When the layered endless belt is produced, the second layer is formed on the outer circumferential surface of the substrate through, for example; a second coating solution preparing step of preparing a second coating solution containing the second resin or a precursor thereof, the second electrically conductive particles, and a second solvent; a second coating film forming step of forming a second coating film by applying the second coating solution to the outer circumferential surface of the substrate; and a second drying step of drying the second coating film. The second layer may be formed, for example, by preparing pellets containing the second resin and the second electrically conductive particles and subjecting the pellets to melt extrusion.

(Coating Solution Preparing Steps)

In the first coating solution preparing step, the first coating solution containing the first resin or a precursor thereof, the first electrically conductive particles, and the first solvent is prepared. For example, when the first resin is a polyimide resin and the first electrically conductive particles are carbon black particles, the first coating solution prepared is, for example, a solution that contains the carbon black particles dispersed in the first solvent and a polyamic acid used as the precursor of the polyimide resin and dissolved in the first solvent. Alternatively, for example, when the first resin is a polyamide-imide resin and the first electrically conductive particles are carbon black particles, the first coating solution prepared is, for example, a solution that contains the carbon black particles dispersed in the first solvent and the polyamide-imide resin dissolved in the first solvent.

In a method for preparing the first coating solution, dispersion treatment may be performed using a mill such as a ball mill or a jet mill, from the viewpoint of pulverizing aggregates of the first electrically conductive particles and from the viewpoint of increasing the dispersibility of the first electrically conductive particles.

No particular limitation is imposed on the first solvent, and the first solvent may be appropriately selected according to, for example, the type of resin used as the first resin. For example, when the first resin is a polyimide resin or a polyamide-imide resin, the first solvent used may be a polar solvent.

Examples of the polar solvent include N-methyl-2-pyrrolidone (NMP), N,N-dimethylformamide (DMF), N,N-dimethylacetamide (DMAc), N,N-diethylacetamide (DEAc), dimethyl sulfoxide (DMSO), hexamethylenephosphoramide (HMPA), N-methylcaprolactam, N-acetyl-2-pyrrolidone, and 1,3-dimethyl-2-imidazolidinone (N,N-dimethylimidazolidinone, DMI), and any of them may be used alone or in combination of two or more.

When the second coating solution preparing step is performed, the second coating solution containing the second resin, the second electrically conductive particles, and the second solvent is prepared in the second coating solution preparing step. The second resin and the second electrically conductive particles are as described above, and a method for preparing the second coating solution and the second solvent are the same as the method for preparing the first coating solution and the first solvent, respectively.

(Coating Film Forming Steps)

In the first coating film forming step, the first coating solution is applied to the outer circumferential surface of a substrate to be coated to form the first coating film.

Examples of the substrate to be coated include hollow cylindrical molds and solid cylindrical molds. The substrate to be coated may be prepared by subjecting the outer circumferential surface of any of the above molds to release agent treatment. When a single-layer endless belt is produced, the first coating solution is directly applied to, for example, the outer circumferential surface of the substrate to be coated or the substrate treated with the release agent in the first coating film forming step. When a layered endless belt is produced, the first coating solution is applied to, for example, the outer circumferential surface of a substrate having the second layer or the second coating film formed thereon in the first coating film forming step.

Examples of the method for applying the first coating solution include known methods such as a spray coating method, a spiral coating (flow coating) method, a blade coating method, a wire bar coating method, a dip coating method, a bead coating method, an air knife coating method, and a curtain coating method.

When the second coating film forming step is performed, the second coating solution is applied to the outer circumferential surface of a substrate to be coated in the second coating film forming step to form the second coating film. The method for applying the second coating solution is the same as the method for applying the first coating solution.

(Drying Steps)

In the first drying step, the first coating film formed in the first coating film forming step is dried. In the first drying step, the first solvent contained in the first coating film is removed, and the single layer or the first layer is thereby obtained.

Examples of the method for drying the first coating film include a method in which hot air is supplied to the first coating film and a method in which the coated substrate is heated.

In the first drying step, an average integral heating rate A/B (° C./min) may be 5.74° C./min or higher. Here, A° C. is the average integral value of the temperature of the coated substrate in the drying step, and B min is the time from when the drying is started to when the temperature of the coated substrate reaches the average integral value A° C. When the average integral heating rate A/B(° C./min) is 5.74° C./min or higher, the endless belt obtained may have good transferability onto a non-smooth paper sheet when used as an intermediate transfer body. Although the reason for this is unclear, the reason may be as follows.

Specifically, when the average integral heating rate A/B is high, the first coating film dries fast. In this case, the first electrically conductive particles are fixed in the first coating film before aggregation of the first electrically conductive particles occurs, so that, in the layer obtained, the dispersion state of the first electrically conductive particles is kept high. It is inferred that, since the first electrically conductive particles are finely dispersed in the layer obtained, the discharge characteristic tends to be satisfied, so that the endless belt may be excellent in the transferability onto a non-smooth paper sheet when used as an intermediate transfer body.

The average integral heating rate A/B is measured as follows. First, a thermometer (e.g., K thermocouple type JBS-7115-5M-K manufactured by GRAPHTEC Corporation) is connected to a data recorder manufactured by GRAPHTEC Corporation (type: GL240) to measure the change in the temperature of the coated substrate over time in the drying step. Then the temperature at which the integral value (area) of the temperature of the coated substrate from the start of drying reaches one half the integral value (area) of the temperature of the coated substrate from the start of drying to the end of drying is defined as "the average integral value (A° C.)." Then the time (B min) from the start of drying to when the temperature of the coated substrate reaches the average integral value A° C. is determined, and the average integral heating rate A/B (° C./min) is computed.

The average integral heating rate A/B (° C./min) is preferably 5.74° C./min or higher and more preferably 8.0° C./min or higher.

No particular limitation is imposed on the method for adjusting the average integral heating rate A/B to the above-described range. Examples of the method when hot air is supplied to the surface of the first coating film to dry the first coating film include a method in which the velocity of the hot air at the surface of the first coating film is controlled and a method in which the temperature of the hot air is controlled.

The velocity of the hot air at the surface of the first coating film is, for example, in the range of from 0.1 m/s to 50 m/s inclusive, preferably in the range of from 1 m/s to 40 m/s inclusive, and more preferably in the range of from 1 m/s to 20 m/s inclusive.

The velocity of the hot air at the surface of the first coating film is measured as follows. Specifically, an anemometer (TM350 manufactured by TASCO) is used, and its probe is disposed on the surface of the coating film to measure the velocity.

The temperature of the hot air at the surface of the first coating film is, for example, in the range of from 100° C. to 280° C. inclusive, preferably in the range of from 100° C. to 250° C. inclusive, and more preferably in the range of from 110° C. to 235° C. inclusive.

The temperature of the hot air at the surface of the first coating film is measured by connecting a thermometer (e.g., K thermocouple type JBS-7115-5M-K manufactured by GRAPHTEC Corporation) to a data recorder manufactured by GRAPHTEC Corporation (type: GL240).

No particular limitation is imposed on the method for supplying the hot air to the surface of the first coating film, and examples thereof include a method in which hot air from a drying furnace is blown from a slit nozzle onto the surface of the first coating film and a method in which the hot air from the drying furnace is supplied directly to the first coating film. Of these, the method using the slit nozzle may be used from the viewpoint of ease of controlling the velocity of the hot air at the surface of the first coating film.

When the second drying step is performed, the second coating film formed in the second coating film forming step is dried in the second drying step. The method for drying the second coating film is the same as the method for drying the first coating film. The second drying step may be completed before the first coating film forming step is performed. The first coating film forming step may be performed before completion of the second drying step, and the first drying step may serve as part of the second drying step.

(Firing Steps)

As described above, in the method for producing the endless belt, the first firing step may be performed. In the first firing step, the first coating film dried in the first drying step is heated and fired. When, for example, the first resin is a polyimide resin, the polyamic acid contained in the first coating film is imidized in the first firing step, and the polyimide is thereby obtained.

The heating temperature in the first firing step is, for example, in the range of from 150° C. to 450° C. inclusive and preferably in the range of from 200° C. to 430° C. inclusive. The heating time in the first firing step is, for example, in the range of from 20 minutes to 180 minutes inclusive and preferably in the range of from 60 minutes to 150 minutes inclusive.

When the second layer is formed through the second coating solution preparing step, the second coating film forming step, and the second drying step in the course of production of the layered endless belt, a second firing step of firing the second coating film dried in the second drying step may be performed. The second firing step may serve also as the first firing step.

[Transfer Device]

A transfer device according to an exemplary embodiment includes: an intermediate transfer body having an outer circumferential surface onto which a toner image is to be transferred; a first transfer unit including a first transfer member that first-transfers the toner image formed on the surface of an image holding member onto the outer circumferential surface of the intermediate transfer body; and a second transfer unit including a second transfer member that is disposed in contact with the outer circumferential surface of the intermediate transfer body and second-transfers the toner image transferred onto the outer circumferential surface of the intermediate transfer body onto a surface of a recording medium. The endless belt according to the preceding exemplary embodiment is used as the intermediate transfer body.

In the first transfer unit, the first transfer member is disposed so as to face the image holding member with the intermediate transfer body therebetween. In the first transfer unit, the first transfer member is used to apply a voltage whose polarity is opposite to the charge polarity of the toner to the intermediate transfer body, and the toner image is thereby first-transferred onto the outer circumferential surface of the intermediate transfer body.

In the second transfer unit, the second transfer member is disposed on the toner image holding side of the intermediate transfer body. The second transfer unit further includes, in addition to the second transfer member, a back member disposed on the side opposite to the toner image holding side of the intermediate transfer body. In the second transfer unit, the intermediate transfer body and a recording medium are sandwiched between the second transfer member and the back member, and a transfer electric field is formed to second-transfer the toner image on the intermediate transfer body onto the recording medium.

The second transfer member may be a second transfer roller or may be a second transfer belt. The back member used is, for example, a back roller.

The transfer device according to the present exemplary embodiment may be a transfer device that transfers a toner image onto the surface of a recording medium through a plurality of intermediate transfer bodies. Specifically, the transfer device may be, for example, as follows. A toner image is first-transferred from the image holding member onto a first intermediate transfer body, and the toner image is second-transferred from the first intermediate transfer body onto a second intermediate transfer body. Then the toner image is third-transferred from the second intermediate transfer body onto a recording medium.

When the transfer device includes a plurality of intermediate transfer bodies, the endless belt according to the preceding exemplary embodiment is applied to at least the intermediate transfer body that transfers a toner image onto a recording medium.

In the transfer device according to the present exemplary embodiment, the second transfer member may be disposed in contact with the outer circumferential surface of the intermediate transfer body. In this case, the contact pressure between the second transfer member and the intermediate transfer body is preferably 1.5 N/cm or more, more preferably 2.1 N/cm or more, and still more preferably from 2.7 N/cm to 6.1 N/cm inclusive.

When the contact pressure is high, i.e., within the above range, air layers in a non-smooth paper sheet can be easily squeezed between the endless belt and the second transfer member in the second transfer region, and the transferability onto the non-smooth paper sheet may be further improved.

In particular, when the microhardness of the outer circumferential surface of the intermediate transfer body is from 350 $nN/mm^2$ to 650 $nN/mm^2$ inclusive and the contact pressure between the second transfer member and the intermediate transfer body is 2.1 N/cm or more, air layers in a non-smooth paper sheet can be easily squeezed between the endless belt and the second transfer member in the second transfer region, and the transferability onto the non-smooth paper sheet may be further improved.

[Image Forming Apparatus]

An image forming apparatus according to an exemplary embodiment includes: a toner image forming device that forms a toner image on a surface of an image holding member; and a transfer device that transfers the toner image formed on the surface of the image holding member onto a surface of a recording medium. The transfer device according to the preceding exemplary embodiment is applied to the above transfer device.

The toner image forming device is, for example, a device including: the image holding member; a charging unit for charging the surface of the image holding member; an electrostatic latent image forming unit that forms an electrostatic latent image on the charged surface of the image holding member; and a developing unit that develops the electrostatic latent image formed on the surface of the image holding member using a developer containing a toner to thereby form a toner image.

The image forming apparatus according to the present exemplary embodiment is applied to well-known image forming apparatuses such as: an apparatus including fixing means for fixing a toner image transferred onto a surface of a recording medium; an apparatus including cleaning means for cleaning the surface of the image holding member after transfer of a toner image but before charging; an apparatus including charge eliminating means for eliminating charges on the surface of the image holding member after transfer of a toner image but before charging by irradiating the surface of the image holding member with charge elimination light; and an apparatus including an image holding member-heating member for increasing the temperature of the image holding member to reduce relative temperature.

The image forming apparatus according to the present exemplary embodiment may be an image forming apparatus of a dry development type or an image forming apparatus of a wet development type (a development type using a liquid developer).

In the image forming apparatus according to the present exemplary embodiment, for example, a portion including the image holding member may have a cartridge structure (process cartridge) that is detachable from the image forming apparatus. The process cartridge used may include a toner image forming device and a transfer device.

In the image forming apparatus according to the present exemplary embodiment, even when the toner used has a volume average particle diameter of 5 μm or less (this toner is hereinafter referred to as a "small-diameter toner"), the transferability onto a non-smooth paper sheet is high. When the small-diameter toner is used to form an image, the resolution of the image is high, and the quality of the image obtained is high. However, since the charge amount per unit volume of the small-diameter toner is large, abnormal discharge is likely to occur when a transfer voltage is applied in the second transfer region. Moreover, the Van der Waals force of the small-diameter toner is strong. Therefore, when reverse charging of the toner due to abnormal discharge occurs, significant white patches tend to occur in the image.

However, in the present exemplary embodiment, the endless belt satisfying the discharge characteristic is used as the intermediate transfer body of the transfer device. Therefore, conductive points are finely dispersed on the outer circumferential surface of the intermediate transfer body, and the abnormal discharge is unlikely to occur. It is therefore inferred that, even when the small-diameter toner is used, the occurrence of white patches in the image is prevented, so that excellent transferability onto a non-smooth paper sheet may be obtained.

The volume average particle diameter of the toner is preferably in the range of from 2 μm to 5 μm inclusive and more preferably in the range of from 3.5 μm to 4.8 μm inclusive.

The volume average particle diameter of the toner is measured using Coulter Multisizer II (manufactured by Beckman Coulter, Inc.), and ISOTON-II (manufactured by Beckman Coulter, Inc.) is used as an electrolyte.

In the measurement, a measurement sample in an amount of from 0.5 mg to 50 mg inclusive is added to 2 mL of a 5% aqueous solution of a surfactant (which may be sodium alkylbenzenesulfonate) serving as a dispersant. The mixture is added to 100 mL to 150 mL of the electrolyte.

The electrolyte with the sample suspended therein is subjected to dispersion treatment for 1 minute using an ultrasonic dispersion apparatus, and then the particle size distribution of particles having diameters within the range of from 2 μm to 60 μm inclusive is measured using an aperture having an aperture diameter of 100 μm in the Coulter Multisizer II. The number of particles sampled is 50000.

The particle size distribution measured and divided into particle size ranges (channels) is used to obtain a volumetric cumulative distribution computed from the small diameter side, and the particle diameter at a cumulative frequency of 50% is defined as the volume average particle diameter.

An example of the image forming apparatus according to the present exemplary embodiment will be described with reference to the drawings. However, the image forming apparatus according to the present exemplary embodiment is not limited thereto. In the following description, major components shown in the drawings will be described, and description of other components will be omitted.

(Image Forming Apparatus)

FIG. 1 is a schematic illustration showing the structure of the image forming apparatus according to the present exemplary embodiment.

As shown in FIG. 1, the image forming apparatus 100 according to the present exemplary embodiment is, for example, an intermediate transfer type image forming apparatus having a so-called tandem configuration and includes: a plurality of image forming units 1Y, 1M, 1C, and 1K (examples of the toner image forming device) that form toner images of respective colors by an electrophotographic process; first transfer units 10 that transfer (first-transfer) the color toner images formed by the image forming units 1Y, 1M, 1C, and 1K sequentially onto an intermediate transfer belt 15; a second transfer unit 20 that transfers (second-transfers) all the superposed toner images transferred onto the intermediate transfer belt 15 at once onto a paper sheet K used as a recording medium; and a fixing device 60 that fixes the second-transferred images onto the paper sheet K. The image forming apparatus 100 further includes a controller 40 that controls the operation of each device (each unit).

Each of the image forming units 1Y, 1M, 1C, and 1K of the image forming apparatus 100 includes a photoreceptor 11 (an example of the image holding member) that rotates in the direction of an arrow A and holds a toner image formed on its surface.

A charging unit 12 that charges the photoreceptor 11 and serves as an example of the charging unit is disposed near the circumference of the photoreceptor 11. A laser exposure unit 13 serving as an example of the electrostatic latent image forming unit and used to write an electrostatic latent image on the photoreceptor 11 is disposed above the photoreceptor 11 (in FIG. 1, an exposure beam is denoted by symbol Bm).

A developing unit 14 that serves as an example of the developing unit, contains a color toner, and visualizes the electrostatic latent image on the photoreceptor 11 with the toner is disposed near the circumference of the photoreceptor 11, and a first transfer roller 16 is provided, which transfers the color toner image formed on the photoreceptor 11 onto the intermediate transfer belt 15 in a corresponding first transfer unit 10.

A photoreceptor cleaner 17 that removes the toner remaining on the photoreceptor 11 is disposed near the circumference of the photoreceptor 11. These electrophotographic devices including the charging unit 12, the laser exposure unit 13, the developing unit 14, the first transfer roller 16, and the photoreceptor cleaner 17 are sequentially arranged in the rotation direction of the photoreceptor 11. The image forming units 1Y, 1M, 1C, and 1K are arranged substantially linearly in the order of yellow (Y), magenta (M), cyan (C), and black (K) from the upstream side of the intermediate transfer belt 15.

The intermediate transfer belt 15 is circulated (rotated) by various rollers in a direction B shown in FIG. 1 at a speed appropriate for its intended use. These rollers include: a driving roller 31 driven by a motor (not shown) excellent in constant speed property to rotate the intermediate transfer belt 15; a support roller 32 that supports the intermediate transfer belt 15 extending substantially linearly in the arrangement direction of the photoreceptors 11; a tension applying roller 33 that applies tension to the intermediate transfer belt 15 and serves as a correction roller for preventing meandering of the intermediate transfer belt 15; a back roller 25 disposed in the second transfer unit 20; and a cleaning back roller 34 disposed in a cleaning unit in which toner remaining on the intermediate transfer belt 15 is scraped off.

Each first transfer unit 10 includes a corresponding first transfer roller 16 facing a corresponding photoreceptor 11 with the intermediate transfer belt 15 therebetween. The first transfer roller 16 is disposed so as to be pressed against the photoreceptor 11 with the intermediate transfer belt 15 therebetween, and a voltage (first transfer bias) whose polarity is opposite to the charge polarity of the toner (negative polarity, the same applies to the following) is applied to the first transfer roller 16. Therefore, the toner images on the photoreceptors 11 are electrostatically attracted to the intermediate transfer belt 15 in a sequential manner, and the toner images are superposed on the intermediate transfer belt 15.

The second transfer unit 20 includes the back roller 25 and a second transfer roller 22 disposed on the toner image holding surface side of the intermediate transfer belt 15.

The back roller 25 is formed such that its surface resistivity is from $1\times10^{7}\Omega/\square$ to $1\times10^{10}\Omega/\square$ inclusive, and its hardness is set to, for example, 70° (ASKER C manufactured by Kobunshi Keiki Co., Ltd., the same applies to the following). The back roller 25 is disposed on the back side of the intermediate transfer belt 15 and forms a counter electrode of the second transfer roller 22, and a metallic feeding roller 26 to which a second transfer bias is stably applied is disposed in contact with the back roller 25.

The second transfer roller 22 is a cylindrical roller having a volume resistivity of from $10^{7.5}$ Ω·cm to $10^{8.5}$ Ω·cm inclusive. The second transfer roller 22 is disposed so as to be pressed against the back roller 25 with the intermediate transfer belt 15 therebetween. The second transfer roller 22 is grounded, and the second transfer bias is formed between the second transfer roller 22 and the back roller 25. The toner images are second-transferred onto a paper sheet K conveyed to the second transfer unit 20.

An intermediate transfer belt cleaning member 35 is disposed downstream of the second transfer unit 20 so as to be separable from the intermediate transfer belt 15. The intermediate transfer belt cleaner 35 removes toner and paper powder remaining on the intermediate transfer belt 15 after second transfer to thereby clean the outer circumferential surface of the intermediate transfer belt 15.

A second transfer roller cleaning member 22A is disposed downstream of the second transfer roller 22 of the second transfer unit 20. The second transfer roller cleaning member 22A removes toner and paper powder remaining on the second transfer roller 22 after second transfer to thereby clean the outer circumferential surface of the intermediate transfer belt 15. Examples of the second transfer roller cleaning member 22A include a cleaning blade. A cleaning roller may also be used.

The intermediate transfer belt 15, the first transfer rollers 16, and the second transfer roller 22 correspond to an example of the transfer device.

Figure 2:
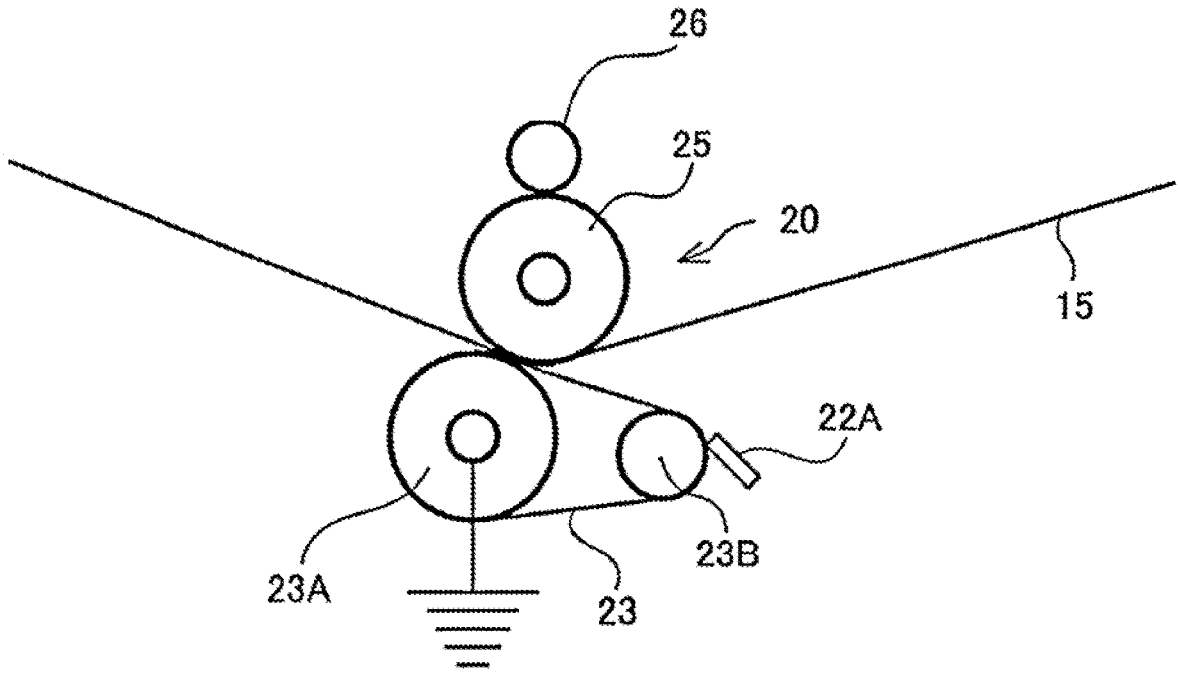
FIG. 2 is a schematic illustration showing the periphery of a second transfer unit in another example of the image forming apparatus according to the exemplary embodiment.

The image forming apparatus 100 may include a second transfer belt (an example of the second transfer member) instead of the second transfer roller 22. Specifically, as shown in FIG. 2, the image forming apparatus 100 may include a second transfer unit including a second transfer belt 23, a driving roller 23A disposed so as to face the back roller 25 with the intermediate transfer belt 15 and the second transfer belt 23 interposed therebetween, and an idler roller 23B that, together with the driving roller 23A, supports the second transfer belt 23 under tension.

A reference sensor (home position sensor) 42 that generates a reference signal used as a reference for image formation timings in the image forming units 1Y, 1M, 1C, and 1K is disposed upstream of the yellow image forming unit 1Y. An image density sensor 43 for image quality adjustment is disposed downstream of the black image forming unit 1K. When the reference sensor 42 detects a mark provided on the back side of the intermediate transfer belt 15, the reference sensor 42 generates the reference signal. The controller 40 issues instructions in response to the reference signal to start image formation in the image forming units 1Y, 1M, 1C, and 1K.

The image forming apparatus according to the present exemplary embodiment further includes, as conveyer means for conveying a paper sheet K: a paper sheet container 50 that houses paper sheets K; a paper feed roller 51 that picks up and conveys the paper sheets K stacked in the paper sheet container 50 one by one at predetermined timing; conveyer rollers 52 that convey each paper sheet K fed by the paper feed roller 51; a conveying guide 53 that feeds the paper sheet K conveyed by the conveyer rollers 52 to the second transfer unit 20; a conveyer belt 55 that conveys, to the fixing device 60, the paper sheet K conveyed by the second transfer roller 22 after second transfer; and a fixation entrance guide 56 that guides the paper sheet K to the fixing device 60.

Next, a basic image forming process of the image forming apparatus according to the present exemplary embodiment will be described.

In the image forming apparatus according to the present exemplary embodiment, image data outputted from, for example, an unillustrated image reading device or an unillustrated personal computer (PC) is subjected to image processing in an unillustrated image processing device, and image forming operations are performed in the image forming units 1Y, 1M, 1C, and 1K.

In the image processing device, the inputted reflectance data is subjected to various types of image processing such as shading compensation, misregistration correction, lightness/color space transformation, gamma correction, frame erasure, and various types of image editing such as color editing and move editing. The image data subjected to the image processing is converted to four types of color tone data including Y color data, M color data, C color data, and K color data, and they are outputted to the respective laser exposure units 13.

In each of the laser exposure units 13, the photoreceptor 11 of a corresponding one of the image forming units 1Y, 1M, 1C, and 1K is irradiated with an exposure beam Bm emitted from, for example, a semiconductor laser according to the inputted color tone data. In each of the image forming units 1Y, 1M, 1C, and 1K, the surface of the photoreceptor 11 is charged by the charging unit 12 and is then scanned and exposed using the laser exposure unit 13, and an electrostatic latent image is thereby formed. The electrostatic latent images formed are developed in the respective image forming units 1Y, 1M, 1C, and 1K to thereby form Y, M, C, and K color images.

The toner images formed on the photoreceptors 11 of the image forming units 1Y, 1M, 1C, and 1K are transferred onto the intermediate transfer belt 15 in the first transfer units 10 in which the photoreceptors 11 come into contact with the intermediate transfer belt 15. More specifically, in each of the first transfer units 10, a voltage (first transfer bias) whose polarity is opposite to the charge polarity (negative polarity) of the toner is applied by the first transfer roller 16 to the base of the intermediate transfer belt 15. The toner images are thereby sequentially superposed onto the outer circumferential surface of the intermediate transfer belt 15, and the first transfer is completed.

After the toner images have been sequentially first-transferred onto the outer circumferential surface of the intermediate transfer belt 15, the intermediate transfer belt 15 moves, and the toner images are conveyed toward the second transfer unit 20. When the toner images are conveyed toward the second transfer unit 20, the paper feed roller 51 in the conveyer means starts rotating at the timing of conveyance of the toner images to the second transfer unit 20 to feed a paper sheet K of the intended size from the paper sheet container 50. The paper sheet K fed by the paper feed roller 51 is conveyed by the conveyer rollers 52 and reaches the second transfer unit 20 through the transfer guide 53. Before the paper sheet K reaches the second transfer unit 20, the paper sheet K is temporarily stopped. Then a registration roller (not shown) starts rotating at an appropriate timing determined by the movement of the intermediate transfer belt 15 with the toner images held thereon, and the position of the paper sheet K is thereby aligned with the position of the toner images.

In the second transfer unit 20, the second transfer roller 22 is pressed against the back roller 25 through the intermediate transfer belt 15 therebetween. In this case, the paper sheet K conveyed at the appropriate timing is pinched between the intermediate transfer belt 15 and the second transfer roller 22. Then, when a voltage (second transfer bias) whose polarity is the same as the charge polarity (negative polarity) of the toner is applied from the feeding roller 26, a transfer electric field is formed between the second transfer roller 22 and the back roller 25. All the unfixed toner images held on the intermediate transfer belt 15 are thereby electrostatically transferred at once onto the paper sheet K in the second transfer unit 20 in which the intermediate transfer belt 15 is pressed by the second transfer roller 22 and the back roller 25.

Then the paper sheet K with the toner images electrostatically transferred thereon is released from the intermediate transfer belt 15 and conveyed by the second transfer roller 22 to the conveyer belt 55 disposed downstream, with respect to the conveyance direction of the paper sheet, of the second transfer roller 22. The conveyer belt 55 conveys the paper sheet K to the fixing device 60 at an optimal conveyance speed for the fixing device 60. The unfixed toner images on the paper sheet K conveyed to the fixing device 60 are subjected to fixation processing using heat and pressure by the fixing device 60 and thereby fixed onto the paper sheet K. The paper sheet K with the fixed image formed thereon is conveyed to an output sheet container (not shown) disposed in an output unit of the image forming apparatus.

After completion of transfer onto the paper sheet K, the toner remaining on the intermediate transfer belt 15 is conveyed to the cleaning unit by the rotation of the intermediate transfer belt 15 and is removed from the intermediate transfer belt 15 by the cleaning back roller 34 and the intermediate transfer belt cleaner 35.

Although the exemplary embodiments have been described, the present disclosure is not to be construed as being limited to the exemplary embodiments, and various modifications, changes, and improvements are possible.

EXAMPLES

Examples of the present disclosure will be described, but the present disclosure is not limited to the following Examples. In the following description, "parts" and "%" are based on mass, unless otherwise specified.

[Production of Endless Belts]

<Production of Endless Belt A1>

—Synthesis of Polyamic Acid—

A polyamic acid DA-A1 having amino groups at both ends of its molecular chain and a polyamic acid DC-A1 having carboxy groups at both ends of its molecular chain are synthesized by the following methods.

—Preparation of polyamic acid solution DA-A1—

83.48 g (416.9 millimoles) of 4,4'-diaminodiphenyl ether (hereinafter abbreviated as "ODA") that is a diamine compound is added to 800 g of N-methyl-2-pyrrolidone (hereinafter abbreviated as "NMP") and dissolved therein at room temperature (25° C.) under stirring.

Next, 116.52 g (396.0 millimoles) of 3,3',4,4'-biphenyltetracarboxylic dianhydride (hereinafter abbreviated as "BPDA") that is a tetracarboxylic dianhydride is gradually added to the mixture. After the tetracarboxylic dianhydride has been added and dissolved, the reaction mixture is heated to a temperature of 60° C. and then subjected to a polymerization reaction for 20 hours while the temperature of the reaction mixture is maintained at 60° C. to thereby obtain a reaction mixture containing the polyamic acid DA-A1 and NMP.

The reaction mixture obtained is filtered through a #800 stainless steel mesh and cooled to room temperature (25° C.), and a polyamic acid solution DA-A1 having a solution viscosity of 2.0 Pa·s at 25° C. is thereby obtained.

The solution viscosity of the polyamic acid solution is a value measured using an E type rotational viscometer TV-20H manufactured by Toki Sangyo Co., Ltd. with a standard rotor (1° 34"×R24) under the conditions of a measurement temperature of 25° C. and rotation speeds of 0.5 rpm (100 Pa·s or more) and 1 rpm (less than 100 Pa·s).

The solution viscosities of polyamic acid solutions obtained in the following Synthesis Examples are values measured as described above.

—Preparation of polyamic acid solution DC-A1—

A polyamic acid solution DC-A1 containing the polyamic acid DC-A1 and NMP and having a solution viscosity of 6.0 Pa·s is obtained using the same procedure as in the above Synthetic Example except that 79.57 g (397.4 millimoles) of ODA and 120.43 g (409.3 millimoles) of BPDA are used.

—Preparation of Coating Solution A1 (Second Coating Solution)—

- Polyamic acid solution DA-A1 (solid content: 45% by mass) 70 parts by mass
- Polyamic acid solution DC-A1 (solid content: 15% by mass) 30 parts by mass
- Acidic carbon black (dried, electrically conductive particles) [SPECIAL BLACK 4 manufactured by Orion Engineered Carbons, pH: 4.5, volatile content: 18.0%, gas black (i.e., channel black), number average primary particle diameter: 25 nm (hereinafter abbreviated as "SB-4")] 26 parts by mass The polyamic acid solution DA-A1 having the above-described composition and the polyamic acid solution DC-A1 having the above-described composition are mixed, and SB-4 is added thereto. The mixture is subjected to dispersion treatment using a ball mill at 30° C. for 12 hours to disperse the SB-4 in the polyamic acid solution mixture. Then the solution mixture containing the SB-4 dispersed therein is filtered through a #400 stainless steel mesh to obtain a coating solution A1 used as the second coating solution.

—Preparation of Coating Solution B1 (First Coating Solution)—

- Polyamic acid solution DA-A1 (solid content: 45% by mass) 70 parts by mass
- Polyamic acid solution DC-A1 (solid content: 15% by mass) 30 parts by mass
- Acidic carbon black (dried, electrically conductive particles) [Color Black FW200 manufactured by Orion Engineered Carbons, gas black (i.e., channel black), number average primary particle diameter: 13 nm, pH: 3.0, (hereinafter abbreviated as "FW200")] 18 parts by mass The polyamic acid solution DA-A1 having the above-described composition and the polyamic acid solution DC-A1 having the above-described composition are mixed, and FW200 is added thereto. The mixture is subjected to dispersion treatment using a ball mill at 30° C. for 12 hours to disperse the FW200 in the polyamic acid solution mixture. Then the solution mixture containing the FW200 dispersed therein is filtered through a #800 stainless steel mesh to obtain a coating solution B1 used as the first coating solution.

—Release Agent Treatment of Substrate to be Coated—

A SUS-made hollow cylindrical mold with an outer diameter of 366 mm and a length of 400 mm is prepared as a substrate to be coated, and its outer circumferential surface is coated with a silicone-based release agent (product name: SEPA-COAT manufactured by Shin-Etsu Chemical Co., Ltd.). The resulting mold is subjected to drying treatment (release agent treatment).

—Formation of Second Coating Film—

While the hollow cylindrical mold subjected to the release agent treatment is rotated circumferentially at a speed of 10 rpm, the coating solution A1 is discharged from a dispenser having a diameter of 1.0 mm onto an end portion of the hollow cylindrical mold. Then a constant pressure is applied to the coating solution A1 using a metal blade disposed on the mold to coat the mold with the coating solution A1. By moving the dispenser unit in the axial direction of the hollow cylindrical mold at a speed of 100 mm/minute, the coating solution A1 is helically applied to the hollow cylindrical mold to thereby form the second coating film.

—Drying of Second Coating Film—

Then the mold and the second coating film are subjected to drying treatment in a drying furnace at 140° C. in an air atmosphere for 15 minute while rotated at 10 rpm.

The solvent is volatilized from the second coating film during drying, and the second coating film is thereby transformed into a polyamic acid resin molded article (base 1) having self-supporting ability.

—Formation and Drying of First Coating Film—

The coating solution B1 is applied to the outer circumferential surface of the base 1 using the same rotation coating method as that used for the application of the coating solution A1 to form the first coating film, and then the first coating film is subjected to drying treatment in a drying furnace at 140° C. in an air atmosphere for 15 minutes while rotated at 10 rpm. The average integral heating rate A/B in the drying step for the first coating film is 6.00° C./min.

—Firing—

Next, the resulting article is placed in an oven at a highest temperature of 320° C. for 4 hours to thereby obtain an endless belt. The total layer thickness of the endless belt (the total thickness of the base layer and the surface layer) is 80 μm. Specifically, the thickness of the base layer is 26.7 μm, and the thickness of the surface layer is 53.3 μm.

The endless belt is removed from the mold. A holder is used to support the removed endless belt under tension, and the endless belt is cut using a cutter with an adjusted insertion angle to obtain an annular member with a diameter ϕ of 366 mm and a width of 369 mm. The thus-produced endless belt is used as an endless belt A1.

The content of the electrically conductive particles with respect to the total mass of the base layer in the endless belt A1 is 22% by mass, and the content of the electrically conductive particles with respect to the total mass of the surface layer is 18% by mass.

The volume resistivity of the endless belt A1 and the surface resistivity of its outer circumferential surface are measured using the above-described methods. The common logarithm of the volume resistivity is 11.5 (log Ω·cm), and the common logarithm of the surface resistivity is 11.5 (log Ω/sq.).

<Production of Endless Belt A2>

An endless belt A2 is obtained using the same procedure as that for the endless belt A1 except that, in the drying step of the first coating film, the first coating film is subjected to drying treatment at 115° C. in an air atmosphere for 20 minutes instead of the drying treatment at 140° C. in an air atmosphere for 15 minutes. The total layer thickness of the endless belt A2 (the total thickness of the base layer and the surface layer) is 80 μm. Specifically, the thickness of the base layer is 26.7 μm, and the thickness of the surface layer is 53.3 μm. The average integral heating rate A/B in the drying step of the first coating film is 5.6° C./min.

The content of the electrically conductive particles with respect to the total mass of the base layer in the endless belt A2 is 22% by mass, and the content of the electrically conductive particles with respect to the total mass of the surface layer is 19% by mass.

The volume resistivity of the endless belt A2 and the surface resistivity of its outer circumferential surface are measured using the above-described methods. The common logarithm of the volume resistivity is 11.8 (log Ω·cm), and the common logarithm of the surface resistivity is 12.0 (log Ω/sq.).

<Production of Endless Belt B1>

36 g (20 phr) of oxidized gas black (channel black, FW200 manufactured by Orion Engineered Carbons, number average primary particle diameter: 13 nm) is added to 1000 g of a wholly aromatic polyimide varnish (solid content: 18% by mass, U-Imide KX manufactured by UNITIKA Ltd., solvent: NMP). The mixture is caused to pass through an orifice with a diameter ϕ of 0.1 mm at a pressure of 200 MPa using a high-pressure collision-type dispersing machine (manufactured by Genus K. K). Then the resulting slurry is divided into two portions, and these portions are caused to collide with each other. This procedure is repeated 5 times to disperse the gas black, and a coating solution B2 used as the first coating solution is thereby obtained.

The obtained coating solution B2 is applied to the outer surface of a SUS-made pipe with a diameter ϕ of 366 mm using a flow coating method such that a prescribed thickness is obtained. The coating solution B2 is dried at 150° C. for 30 minutes while the pipe is rotated, and the pipe is placed in an oven at 320° C. for 4 hours and then removed to thereby obtain a SUS-made pipe with an endless belt formed on its outer surface. The total layer thickness of the endless belt (i.e., the thickness of the single layer) is 80 μm. The average integral heating rate A/B in the drying step is 8.0° C./min.

The endless belt covering the outer surface is removed from the SUS-made pipe and cut such that the width of the belt is 369 mm to thereby obtain an endless belt B1. The content of the electrically conductive particles with respect to the total mass of the endless belt B1 is 22% by mass.

The volume resistivity of the endless belt B1 and the surface resistivity of its outer circumferential surface are measured using the above-described methods. The common logarithm of the volume resistivity is 10.1 (log Ω·cm), and the common logarithm of the surface resistivity is 10.0 (log Ω/sq.).

<Production of Endless Belt B2>

An endless belt B2 is obtained using the same procedure as that for the endless belt B1 except that 13.5 g (8 phr) of nitric acid-treated and sodium sulfonate-treated furnace black (EMPEROR 2000 manufactured by Cabot Corporation, number average primary particle diameter: 9 nm) is used as the first electrically conductive particles and that the procedure for colliding two portions of the slurry using the high-pressure collision-type dispersing machine (manufactured by Genus K. K) is repeated 20 times. The total layer thickness of the endless belt B2 (i.e., the thickness of the single layer) is 80 μm. The content of the electrically conductive particles with respect to the total mass of the belt B2 is 7.4% by mass.

The volume resistivity of the belt B2 and the surface resistivity of its outer circumferential surface are measured using the above-described methods. The common logarithm of the volume resistivity is 9.9 (log Ω·cm), and the common logarithm of the surface resistivity is 9.6 (log Ω/sq.).

<Production of Belt B3>

—Formation and Drying of First Coating Film—

The same polyimide precursor solution as that used for the endless belt B2 is applied to the outer circumferential surface of a SUS mold having an outer diameter of 366 mm and a thickness of 10 mm using a flow coating method such that a desired thickness is obtained to thereby form the first coating film, and the first coating film is dried as follows.

Specifically, a slit nozzle (DLX series manufactured by Daico Thermotec Co., Ltd., slit width: 0.8 mm) installed in a blowing portion of a downflow-type hot air dryer is used with the wind velocity near the mold set to 6 m/s to heat the mold to 200° C. for 18 minutes. The average integral heating rate A/B in the drying step is 8.24° C./min.

After drying, the first coating film is sintered at 320° C. for 4 hours to thereby obtain an endless belt. The total layer thickness of the endless belt (i.e., the thickness of the single layer) is 80 μm.

The obtained endless belt is removed from the mold and cut such that the width of the belt is 369 mm, and an endless belt B3 is thereby obtained. The content of the electrically conductive particles with respect to the total mass of the endless belt B3 is 19% by mass.

The volume resistivity of the endless belt B3 and the surface resistivity of its outer circumferential surface are measured using the above-described methods. The common logarithm of the volume resistivity is 11.5 (log Ω·cm), and the common logarithm of the surface resistivity is 11.3 (log Ω/sq.).

<Production of Belt C1>

10% by mass of a polyaniline resin (912409 manufactured by Sigma-Aldrich) is mixed with the coating solution B1 used to produce the endless belt A1 to thereby obtain a coating solution C1 serving as the first coating solution.

The same mold as the substrate to be coated used to produce the endless belt A1 is prepared and subjected to the same release agent treatment.

Using the same rotation application method as that for the application of the coating solution A1 in the production of the endless belt A1, the coating solution C1 is applied to the outer circumferential surface of the substrate subjected to the release agent treatment to form the first coating film. Then the first coating film is subjected to drying treatment in a drying furnace at 150° C. in an air atmosphere for 15 minutes while rotated at 10 rpm. The average integral heating rate A/B in the drying step of the first coating film is 6.0° C./min.

Next, the mold is placed in an oven at a highest temperature of 290° C. for 4 hours to obtain an endless belt. The total layer thickness of the endless belt (i.e., the thickness of the single layer) is 80 μm.

The endless belt is removed from the mold and cut in the same manner as that for the endless belt A1 to thereby obtain an endless belt C1 with a diameter ϕ of 366 mm and a width of 369.5 mm.

The content of the electrically conductive particles with respect to the total mass of the belt C1 is 19% by mass.

The volume resistivity of the belt C1 and the surface resistivity of its outer circumferential surface are measured using the above-described methods. The common logarithm of the volume resistivity is 10.3 (log Ω·cm), and the common logarithm of the surface resistivity is 10.5 (log Ω/sq.).

<Production of Belt C2>

10% by mass of a polyethylene glycol resin (649805 manufactured by Sigma-Aldrich) is mixed with the coating solution B1 used to produce the endless belt A1 to obtain a coating solution C2 used as the first coating solution.

The same mold as the substrate to be coated used to produce the endless belt A1 is prepared and subjected to the same release agent treatment.

Using the same rotation application method as that for the application of the coating solution A1 in the production of the endless belt A1, the coating solution C2 is applied to the outer circumferential surface of the substrate subjected to the release agent treatment to form the first coating film. Then the first coating film is subjected to drying treatment in a drying furnace at 150° C. in an air atmosphere for 15 minutes while rotated at 10 rpm. The average integral heating rate A/B in the drying step of the first coating film is 6.0° C./min.

Next, the mold is placed in an oven at a highest temperature of 290° C. for 4 hours to obtain an endless belt. The total layer thickness of the endless belt (i.e., the thickness of the single layer) is 80 μm.

The endless belt is removed from the mold and cut in the same manner as that for the endless belt A1 to thereby obtain an endless belt C2 with a diameter ϕ of 366 mm and a width of 369.5 mm.

The content of the electrically conductive particles with respect to the total mass of the belt C2 is 19% by mass.

The volume resistivity of the endless belt C2 and the surface resistivity of its outer circumferential surface are measured using the above-described methods. The common logarithm of the volume resistivity is 10.5 (log Ω·cm), and the common logarithm of the surface resistivity is 10.6 (log Ω/sq.).

<Production of Belt C3>

27 g of oxidized gas black (channel black, FW200 manufactured by Orion Engineered Carbons, number average primary particle diameter: 13 nm) used as first electrically conductive particles and 3 g of indium tin oxide (790346 manufactured by Sigma-Aldrich) used as additional first electrically conductive particles are added to 1000 g of a wholly aromatic polyimide varnish (solid content: 18% by mass, U-Imide KX manufactured by UNITIKA Ltd., solvent: NMP). The mixture is caused to pass through an orifice of a diameter ϕ of 0.1 mm at a pressure of 200 MPa using a high-pressure collision-type dispersing machine (manufactured by Genus K. K). Then the resulting slurry is divided into two portions, and these portions are caused to collide with each other. This procedure is repeated 5 times to disperse the gas black, and a coating solution C3 used as the first coating solution is thereby obtained.

The same mold as the substrate to be coated used to produce the endless belt A1 is prepared and subjected to the same release agent treatment.

Using the same rotation application method as that for the application of the coating solution A1 in the production of the endless belt A1, the coating solution C3 is applied to the outer circumferential surface of the substrate subjected to the release agent treatment to form the first coating film. Then the first coating film is subjected to drying treatment in a drying furnace at 150° C. in an air atmosphere for 15 minutes while rotated at 10 rpm. The average integral heating rate A/B in the drying step of the first coating film is 6.0° C./min.

Next, the mold is placed in an oven at a highest temperature of 290° C. for 4 hours to obtain an endless belt. The total layer thickness of the endless belt (i.e., the thickness of the single layer) is 80 μm.

The endless belt is removed from the mold and cut in the same manner as that for the endless belt A1 to thereby obtain an endless belt C3 with a diameter ϕ of 366 mm and a width of 369.5 mm.

The content of the electrically conductive particles with respect to the total mass of the belt C3 is 16% by mass.

The volume resistivity of the endless belt C3 and the surface resistivity of its outer circumferential surface are measured using the above-described methods. The common logarithm of the volume resistivity is 10.2 (log Ω·cm), and the common logarithm of the surface resistivity is 10.1 (log Ω/sq.).

<Production of belt D1>

36 g (20 phr) of oxidized gas black (channel black, SB4 manufactured by Orion Engineered Carbons, number average primary particle diameter: 25 nm) used as the first electrically conductive particles is added to 1000 g of a wholly aromatic polyimide varnish (solid content: 18% by mass, U-Imide KX manufactured by UNITIKA Ltd., solvent: NMP). The mixture is caused to pass through an orifice with a diameter ϕ of 0.1 mm at a pressure of 200 MPa using a high-pressure collision-type dispersing machine (manufactured by Genus K. K). Then the resulting slurry is divided into two portions, and these portions are caused to collide with each other. This procedure is repeated 5 times to disperse the gas black, and a coating solution D1 used as the first coating solution is thereby obtained.

The obtained coating solution D1 is applied to the outer surface of a SUS-made pipe with a diameter ϕ of 366 mm using a flow coating method such that a prescribed thickness is obtained. The coating solution D1 is dried at 140° C. for 15 minutes while the pipe is rotated, and the pipe is placed in an oven at 320° C. for 4 hours and then removed to thereby obtain a SUS-made pipe with an endless belt formed on its outer surface. The total layer thickness of the endless belt D1 (i.e., the thickness of the single layer) is 80 μm. The average integral heating rate A/B in the drying step is 6.0° C./min.

The endless belt covering the outer surface is removed from the SUS-made pipe and cut such that the width of the belt is 369 mm to thereby obtain an endless belt D1. The content of the electrically conductive particles with respect to the total mass of the endless belt D1 is 22% by mass.

The volume resistivity of the endless belt D1 and the surface resistivity of its outer circumferential surface are measured using the above-described methods. The common logarithm of the volume resistivity is 10.5 (log Ω·cm), and the common logarithm of the surface resistivity is 11.0 (log Ω/sq.).

<Production of Belt D4>

36 g (20 phr) of oxidized gas black (channel black, SB4 manufactured by Orion Engineered Carbons, number average primary particle diameter: 25 nm) used as the first electrically conductive particles is added to 1000 g of a wholly aromatic polyimide varnish (solid content: 18% by mass, U-Imide KX manufactured by UNITIKA Ltd., solvent: NMP). The mixture is caused to pass through an orifice with a diameter ϕ of 0.1 mm at a pressure of 200 MPa using a high-pressure collision-type dispersing machine (manufactured by Genus K. K). Then the resulting slurry is divided into two portions, and these portions are caused to collide with each other. This procedure is repeated 30 times to disperse the gas black, and a coating solution D4 used as the first coating solution is thereby obtained.

The obtained coating solution D4 is applied to the outer surface of a SUS-made pipe with a diameter ϕ of 366 mm using a flow coating method such that a prescribed thickness is obtained. The coating solution D4 is dried at 140° C. for 15 minutes while the pipe is rotated, and the pipe is placed in an oven at 320° C. for 4 hours and then removed to thereby obtain a SUS-made pipe with an endless belt formed on its outer surface. The total layer thickness of the endless belt (i.e., the thickness of the single layer) is 80 μm. The average integral heating rate A/B in the drying step is 6.0° C./min.

The endless belt covering the outer surface is removed from the SUS-made pipe and cut such that the width of the belt is 369 mm to thereby obtain an endless belt D4. The content of the electrically conductive particles with respect to the total mass of the endless belt D4 is 20% by mass.

The volume resistivity of the endless belt D4 and the surface resistivity of its outer circumferential surface are measured using the above-described methods. The common logarithm of the volume resistivity is 10.3 (log Ω·cm), and the common logarithm of the surface resistivity is 10.8 (log Ω/sq.).

[Evaluation of Properties of Endless Belts]

For each of the obtained endless belts, the following properties are determined by the methods described above. The results are shown in Table 1.

Integrated discharge amount in a period of 1 second after the voltage applied reaches 1300 V Microhardness of the outer circumferential surface of each endless belt The layer structure of each endless belt, the type of resin contained in the single layer or the first layer, and the number average primary particle diameter of the electrically conductive particles contained in the single layer or the first layer are shown in Table 1. The number average primary particle diameter of the electrically conductive particles in the belt C3 is the particle diameter of gas black.

Examples A1-A7, B1-B6, and C1 to C3 and Comparative Examples D1-D4

<Evaluation of Transferability onto Non-Smooth Paper Sheet (1)>

One of the endless belts shown in Table 1 is installed as the intermediate transfer belt to "an apparatus obtained by modifying DocuColor-7171P (i.e., a modified apparatus obtained by attaching the intermediate transfer belt and adjusting a cleaning blade according to the thickness of the belt)." Then a blue solid image is formed on a non-smooth paper sheet (LEATHAC 66, 204 gsm) in an environment at a temperature of 22° C. and a humidity of 55% RH under the condition of a recording medium conveying speed of 366 mm/s in the second transfer region, and white patches in recessed portions are visually evaluated. The evaluation criteria are shown below, and the results are shown in Table 1.

The second transfer roller used is an electrically conductive roller (1) described below, and the contact pressure between the second transfer roller and the circumferential surface of the endless belt (i.e., the intermediate transfer belt) is set to a value shown in Table 1.

The toner used has a volume average particle diameter of 4.7 μm.

—Evaluation Criteria—

A: No white patches occur.

B: Slight color changes occur.

C: Distinct color changes occur.

D: White patches occur.

<Production of Electrically Conductive Roller (1)>

Epichlorohydrin-allyl glycidyl ether binary copolymer (ECO) (product name: GECHRON manufactured by ZEON CORPORATION) 40 parts by mass Acrylonitrile-butadiene rubber (NBR) (product name: Nipol DN223 manufactured by ZEON CORPORATION) 60 parts by mass Foaming agent (benzenesulfonyl hydrazide) 6 parts by mass Vulcanizing agent (product name: sulfur 200 mesh manufactured by Tsurumi Chemical Industry Co., ltd.) 1 part by mass Vulcanizing accelerator (product name: NOCCELER M manufactured by OUCHI SHINKO CHEMICAL INDUSTRIAL CO., LTD.) 1.5 parts by mass A rubber composition containing the above components is kneaded using an open roll mill. The kneaded rubber composition is extruded into a shape with a central hole (a donut shape) to form a hollow cylindrical roller. Then the hollow cylindrical roller is heated to 160° C. for 20 minutes to vulcanize and foam the composition, and the electrically conductive roller (1) is thereby obtained.

TABLE 1

| | Type of belt | Layer structure | Resin | Electrically conductive particles: Type | Electrically conductive particles: Primary particle diameter (nm) | Integrated discharge amount (μC) | Microhardness nN/mm$^2$ | Contact pressure (N/cm) | Transferability evaluation 1 |
|---|---|---|---|---|---|---|---|---|---|
| Example A1 | A1 | Layered belt | PI | CB | 13 | 274 | 541 | 3.0 | A |
| Example A2 | A2 | Layered belt | PI | CB | 13 | 350 | 615 | 2.1 | B |
| Example A3 | A2 | Layered belt | PI | CB | 13 | 350 | 615 | 3.0 | A |
| Example A4 | A2 | Layered belt | PI | CB | 13 | 350 | 615 | 3.6 | A |
| Example A5 | A2 | Layered belt | PI | CB | 13 | 350 | 615 | 4.6 | A |
| Example A6 | A2 | Layered belt | PI | CB | 13 | 350 | 615 | 5.5 | A |
| Example A7 | A2 | Layered belt | PI | CB | 13 | 350 | 615 | 6.1 | A |
| Example B1 | B1 | Single-layer belt | PI | CB | 13 | 212 | 506 | 3.0 | A |
| Example B2 | B2 | Single-layer belt | PI | CB | 9 | 190 | 483 | 3.0 | A |
| Example B3 | B3 | Single-layer belt | PI | CB | 9 | 145 | 436 | 2.1 | A |
| Example B4 | B3 | Single-layer belt | PI | CB | 9 | 145 | 436 | 3.0 | A |
| Example B5 | B3 | Single-layer belt | PI | CB | 9 | 145 | 436 | 4.6 | A |
| Example B6 | B3 | Single-layer belt | PI | CB | 9 | 145 | 436 | 6.1 | A |
| Example C1 | C1 | Single-layer belt | PI + PANI | CB | 13 | 178 | 492 | 3.0 | A |
| Example C2 | C2 | Single-layer belt | PI + PEG | CB | 13 | 186 | 483 | 3.0 | A |
| Example C3 | C3 | Single-layer belt | PI | CB + ITO | 13 | 171 | 516 | 3.0 | A |
| Comparative Example D1 | D1 | Single-layer belt | PI | CB | 25 | 750 | 673 | 2.1 | D |
| Comparative Example D2 | D1 | Single-layer belt | PI | CB | 25 | 750 | 673 | 3.0 | D |
| Comparative Example D3 | D1 | Single-layer belt | PI | CB | 25 | 750 | 673 | 6.1 | C |
| Comparative Example D4 | D4 | Single-layer belt | PI | CB | 25 | 421 | 656 | 3.0 | C |

As can be seen from the above results, the transferability onto a non-smooth paper sheet in each Example is better than that in each Comparative Example.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An endless belt comprising:

a resin; and electrically conductive particles, wherein an integrated discharge amount is 350 μC or less, the integrated discharge amount being determined by disposing an electrode at a position spaced 60 μm apart from the outer circumferential surface of the belt, applying a voltage to the electrode, and measuring the amount of discharge for a period of 1 second after the voltage reaches 1300 V.

2. The endless belt according to claim 1, wherein the integrated discharge amount is from 10 μC to 200 μC inclusive.

3. The endless belt according to claim 1, wherein the electrically conductive particles are at least one type of particles selected from the group consisting of electrically conductive carbon particles and metal oxide particles.

4. The endless belt according to claim 2, wherein the electrically conductive particles are at least one type of particles selected from the group consisting of electrically conductive carbon particles and metal oxide particles.

5. The endless belt according to claim 1, wherein the number average primary particle diameter of the electrically conductive particles is from 8 nm to 15 nm inclusive.

6. The endless belt according to claim 2, wherein the number average primary particle diameter of the electrically conductive particles is from 8 nm to 15 nm inclusive.

7. The endless belt according to claim 3, wherein the number average primary particle diameter of the electrically conductive particles is from 8 nm to 15 nm inclusive.

8. The endless belt according to claim 4, wherein the number average primary particle diameter of the electrically conductive particles is from 8 nm to 15 nm inclusive.

9. The endless belt according to claim 1, wherein the resin includes an electrically conductive resin.

10. The endless belt according to claim 2, wherein the resin includes an electrically conductive resin.

11. The endless belt according to claim 3, wherein the resin includes an electrically conductive resin.

12. The endless belt according to claim 4, wherein the resin includes an electrically conductive resin.

13. The endless belt according to claim 5, wherein the resin includes an electrically conductive resin.

14. The endless belt according to claim 6, wherein the resin includes an electrically conductive resin.

15. The endless belt according to claim 9, wherein the electrically conductive resin is at least one selected from the group consisting of polyaniline resins and polyether resins.

16. The endless belt according to claim 1, wherein the microhardness of the outer circumferential surface of the endless belt is from 350 nN/mm$^2$ to 650 nN/mm$^2$ inclusive.

17. A transfer device comprising:

an intermediate transfer body including the endless belt according to claim 1;

a first transfer unit including a first transfer member that first-transfers a toner image formed on a surface of an image holding member onto the outer circumferential surface of the intermediate transfer body; and a second transfer unit including a second transfer member that is disposed in contact with the outer circumferential surface of the intermediate transfer body and second-transfers the toner image transferred onto the outer circumferential surface of the intermediate transfer body onto a surface of a recording medium.

18. The transfer device according to claim 17, wherein the second transfer member is disposed in contact with the outer circumferential surface of the intermediate transfer body, and wherein the contact pressure between the second transfer member and the intermediate transfer body is 1.5 N/cm or more.

19. The transfer device according to claim 18, wherein the contact pressure between the second transfer member and the intermediate transfer body is from 2.7 N/cm to 6.5 N/cm inclusive.

20. An image forming apparatus comprising:

a toner image forming device that includes an image holding member and forms a toner image on a surface of the image holding member; and a transfer device that transfers the toner image formed on the surface of the image holding member onto a surface of a recording medium, the transfer device being the transfer device according to claim 17.

* * * * *